US010137444B2

(12) United States Patent
Beroz et al.

(10) Patent No.: US 10,137,444 B2
(45) Date of Patent: Nov. 27, 2018

(54) NANOLITER PIPETTING DEVICE

(71) Applicant: Massachusetts Institute of Technology, Cambridge, MA (US)

(72) Inventors: Justin Beroz, Cambridge, MA (US); Jacob Rothman, Cambridge, MA (US); Adrian Samsel, Cambridge, MA (US); Anastasios John Hart, Waban, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 0 days.

(21) Appl. No.: 15/590,131

(22) Filed: May 9, 2017

(65) Prior Publication Data

US 2017/0326542 A1 Nov. 16, 2017

Related U.S. Application Data

(60) Provisional application No. 62/334,709, filed on May 11, 2016.

(51) Int. Cl.
*B01L 3/02* (2006.01)

(52) U.S. Cl.
CPC ..... *B01L 3/0217* (2013.01); *B01L 3/0275* (2013.01); *B01L 3/02* (2013.01); *B01L 3/021* (2013.01)

(58) Field of Classification Search
CPC .... B01L 3/0293; B01L 3/0217; B01L 3/0227; B01L 3/0275; B01L 2200/148; B01L 2200/141; B01L 2200/023; B01L 2200/146; B01L 2400/0478; B01L 2400/0481; B01L 3/021; B01L 3/02; B01L 3/0203
USPC ..... 73/864.11, 864.13, 864.16; 422/501, 422/502, 504, 505, 516, 922, 923; 436/180
See application file for complete search history.

(56) References Cited

U.S. PATENT DOCUMENTS

| | | | |
|---|---|---|---|
| 3,144,005 | A | 8/1964 | Johmann |
| 4,838,722 | A | 6/1989 | Katz |
| 5,011,317 | A | 4/1991 | Gueret |
| 5,343,909 | A | 9/1994 | Goodman |
| 5,747,709 | A | 5/1998 | Oshikubo |

(Continued)

FOREIGN PATENT DOCUMENTS

| | | | |
|---|---|---|---|
| DE | 102010045452 | 3/2012 | |
| DE | 102010045452 A1 * | 3/2012 | ..... B01L 3/021 |

OTHER PUBLICATIONS

Beroz and Hart, Universal handheld micropipette, Review of Scientific Instruments, 2016, pp. 115112-1-115112-8, vol. 87, Issue 11, AIP Publishing, NY, US.

(Continued)

*Primary Examiner* — Manish S Shah
*Assistant Examiner* — Suman K Nath
(74) *Attorney, Agent, or Firm* — Nutter McClennen & Fish LLP

(57) ABSTRACT

Nanoliter pipette assembly. The assembly includes a housing containing a working fluid in a working fluid chamber therein and includes a moveable piston within the housing, the piston moveable by a linear actuation mechanism for contact with the working fluid. A tip portion is provided that includes a diaphragm deformable to engage an inner portion of the tip. It is preferred that the diaphragm have a projecting three-dimensional structure for direct contact with a liquid.

21 Claims, 6 Drawing Sheets

(56) References Cited

U.S. PATENT DOCUMENTS

| | | | | |
|---|---|---|---|---|
| 6,287,035 | B1 | 9/2001 | Causton et al. | |
| 6,499,364 | B1 * | 12/2002 | Suovaniemi | B01L 3/0217 73/864.14 |
| 2005/0119618 | A1 | 6/2005 | Gonnelli | |
| 2006/0222570 | A1 * | 10/2006 | Molitor | B01L 3/021 422/400 |
| 2013/0283884 | A1 | 10/2013 | Beroz et al. | |

OTHER PUBLICATIONS

Transmittal of the International Search Report and the Written Opinion of the International Searching Authority for PCT/US2017/31891 dated Aug. 11, 2017.

Beroz, J., et al., Universal handheld micropipette—Supplemental Information. Rev Sci Instrum. Nov. 2016;87 (11):115112, 12 Pages, AIP Publishing, NY, US.

* cited by examiner

NANOLITER PIPETTING DEVICE

This application claims priority to provisional application Ser. No. 62/334,709 filed on May 11, 2016, the contents of which are incorporated herein by reference in their entirety.

BACKGROUND OF THE INVENTION

This invention relates to a pipetting device for drawing and dispensing small liquid volumes from approximately 1-1000 nanoliters.

Handheld pipettes are a ubiquitous tool; they are found across industry and academia in essentially all wet laboratories, and are essential to accurate laboratory work in the fields of chemistry, biology, and medicine. They are used for manipulating small volumes of fluid, and still make up the largest percentage of the US liquid handling market. Hand held pipettes offer the convenience, flexibility, ease of use, and low cost that more complex liquid handling solutions cannot offer.

Handheld pipettes operate under very simple physical principles. They consist of several main components: an internal piston, a spring loaded plunger, a disposable tip, an adjustable stop, and a fixed stop. The pipette is held in one hand by the user, and a volume is selected by moving the adjustable stop. The user then presses the plunger down to the adjustable stop. This causes the piston to displace a volume, $V_p$. The pipette is then lowered into the fluid and the plunger is slowly released. As the spring forces the piston to move back to its initial position, the pressure in the tip lowers and a volume, $V_p$, of fluid is drawn into the tip. The fluid can then be dispensed into another container by depressing the plunger to the second stop.

As previously mentioned, their ease of use and low cost has led to their widespread adoption; however, there are several important limitations of current handheld pipettes. Pipetting volumes smaller than 1000 nanoliters is challenging and typically imprecise (accuracy ~25%). Volumes smaller than 100 nanoliters is currently inaccessible. Under the current pipette operating principles, in order to achieve such small volumes, extremely small piston diameters must be used, which are in most cases not manufacturable. Because the piston diameter is fixed, the range of volumes a given pipette can dispense is limited by the piston range. As a result, labs will often have to purchase a variety of pipettes to dispense volumes in every range they may need. Pipette volume resolution is determined by the positional resolution of the hard stop and the diameter of the piston. When purchasing a pipette there is often a tradeoff between resolution and range.

Therefore, current pipetting technology is not suitable for manipulating smaller volumes. Reducing the volumes that a pipette can aspirate and dispense will allow labs to conserve resources, lower their costs, and perform more experiments.

SUMMARY OF THE INVENTION

The nanoliter pipette assembly according to the invention includes a housing containing a working fluid in a working fluid chamber therein. A piston is provided that is moveable within the housing by a linear actuation mechanism for contact with the working fluid. A tip portion is provided having a diaphragm therein, the diaphragm deformable to engage an inner portion of the tip. The diaphragm and tip portion each include an orifice for aspirating and dispensing a selected fluid wherein the linear actuating mechanism, diaphragm properties and housing properties are selected so that the piston displaces a first volumetric amount of the working fluid on one side of the diaphragm and in which the diaphragm displaces a second volumetric amount of the selected fluid on the opposite side of the diaphragm via direct contact with the selected fluid. The second volumetric amount is less than the first volumetric amount providing a deamplification ratio. In a preferred embodiment, the diaphragm orifice includes a projection that mates with an orifice in the tip. The diaphragm, projection and internal surface of the tip portion are wetted by the selected fluid. A suitable working fluid is a compressible gas such as air.

In another preferred embodiment, the adjustable diaphragm parameters include diaphragm radius, diaphragm thickness, diaphragm shear modulus and diaphragm prestretch. In yet another preferred embodiment, the linear actuation mechanism includes a series of cams to provide repeatability and adjustability of the selected fluid volumes.

It is also preferred that the liquid to be drawn completely wets an exterior side of the diaphragm and an inner surface of the tip in such a manner that when the liquid is drawn there is no air, and thereby no liquid-air interface inside the pipette tip. It is also preferred that the projection on the diaphragm (nipple) protrudes through the orifice in the tip to provide direct contact with the liquid, so as to prevent the volume of drawn liquid from being influenced by capillary pressure that is a primary limitation to pipetting smaller volumes with current handheld pipettes. It is also preferred that the outer surface of the pipette tip be non-wetting so that liquid does not stick to it. It is further preferred that the orifice be small, on the order or tens of microns in lateral dimension to minimize volume loss due to evaporation for volatile liquids.

It is also preferred that the diaphragm is elastic and that the working fluid is a compressible gas such as air. The invention disclosed herein allows the volume displacement of the diaphragm to be a scaled amount of the piston's displacement based on the diaphragm's stiffness and air's compressibility.

DESCRIPTION OF THE PREFERRED EMBODIMENT

As will become apparent from the following disclosure, a pipette tip, including a diaphragm, in combination with a novel piston linear actuation mechanism, may be configured as pan of a high-resolution pipette assembly, that can dispense volumes of fluid as small as one nanoliter. The components function via a volume deamplification concept in which a pipette piston displaces a volumetric amount of a working fluid on one side of the diaphragm placed in the tip and in which the diaphragm displaces a smaller volumetric amount of fluid at an opposite side of the diaphragm via direct contact with the fluid. This displacement reduction from one side of the diaphragm to the other may be characterized by a deamplification ratio that can span multiple orders of magnitude. One or more portions of a fluid chamber that encloses the working fluid may undergo elastic deformation to facilitate the deamplification. Additionally or alternatively, the working fluid may be compressible to contribute to the deamplification. The deamplification ratio and resolution may also be adjustable.

Figure 1:
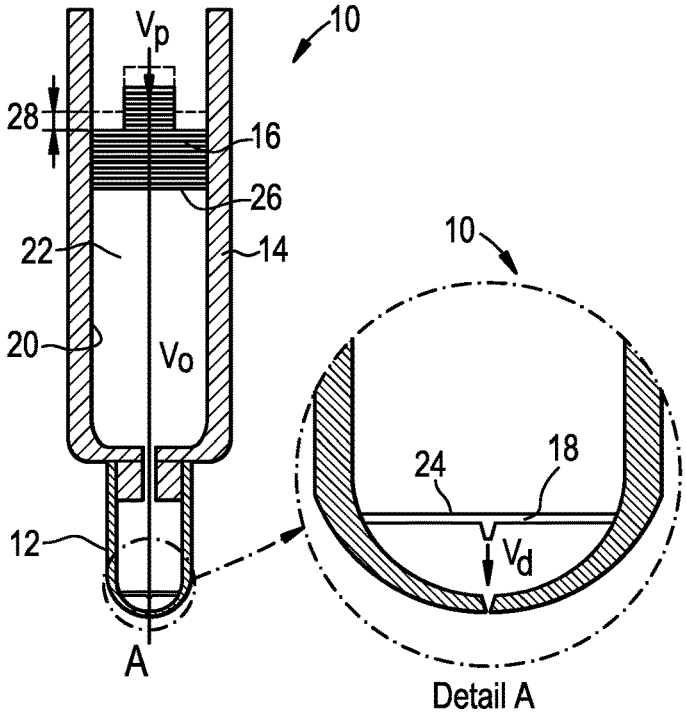
FIG. 1 is a cross-sectional view, along with detail, of an embodiment of the invention disclosed herein.

Referring to FIG. 1, a schematic cross-sectional view of the nanoliter pipette is shown. The pipette assembly 10 consists of a tip 12, a housing, 14, a piston and accompanying mechanism 16, and a diaphragm 18 constrained in the tip. The piston and diaphragm define an adjustable fluid chamber, 20. The working fluid 22 is in contact with the piston 16 and the chamber side 24 of the diaphragm. The piston 16 is movable and displaces the working fluid 22 within the chamber 20. The illustrated embodiment is not to scale. The tip 12 consists of several separate pieces that are used to form a fluid tight seal with the diaphragm 18 and the housing 14, using sealing methods known to those skilled in the art.

In operation, still referring to FIG. 1, the piston 16 moves to displace a volumetric amount of working fluid 22 within the fluid chamber 20. The volume displaced, $V_p$, by the piston 16 is equal to the product of the surface area of surface 26 and the distance 28 the piston has moved. The piston 16 is shown in this displaced position after being moved from its initial position shown in dashed lines. The volume displacement, $V_p$, causes a corresponding volume displacement, $V_d$, by the diaphragm 18.

Figure 2A:
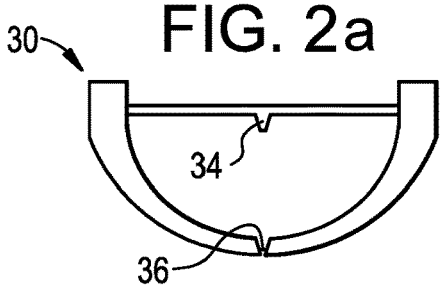
FIGS. 2*a*, 2*b*, 2*c* and 2*d* are cross-sectional views of device tips showing a sequence of diaphragm positions.
Figure 2B:
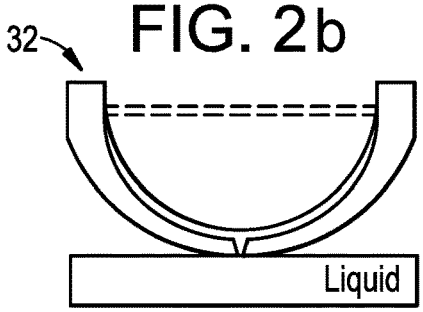
Figure 2C:
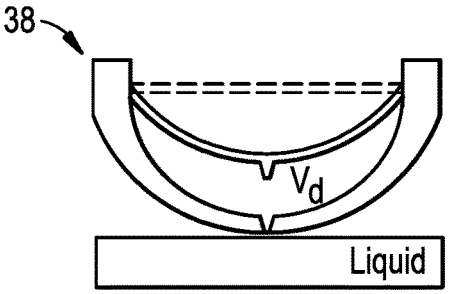
Figure 2D:
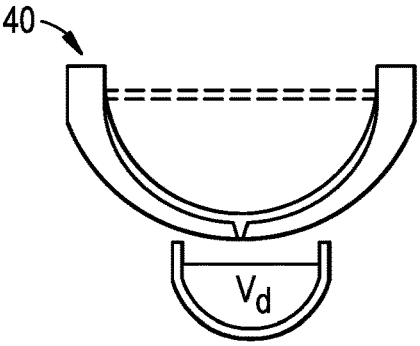

Due to the small volumes the tip 12 will be handling, a novel piston and accompanying mechanism 16 has been designed. Details of how the piston and piston mechanism 16 deflect the diaphragm 18 to aspirate and dispense fluid can be seen in FIGS. 2*a*-2*d*, cross-sectional schematics of the pipette tip. In step 1 in FIG. 2*a*, 30, the operator sets the stop to determine volume to dispense, $V_d$. In step 2 in FIG. 2*b*, 32, the operator depresses the piston 16 to the bottom of its stroke, deflecting the diaphragm 18 to its maximum position. At this point, a three dimensional feature 34 contacts the fluid. Because the pipette is dispensing fluids as small as 1 nL, evaporation becomes a concern. If proper design considerations are not made, a large percentage of aspirated fluid can evaporate in the time it takes to aspirate the fluid and dispense it in the appropriate container. An orifice 36 on the pipette tip 12 was designed to be extremely small, limiting evaporation. However, as this orifice 36 becomes smaller and smaller, the more difficult it becomes to aspirate and dispense fluid accurately due to an increase in capillary pressure. Therefore, the fluid facing surface of the diaphragm 18 is designed with a three dimensional feature 34. During step 2 (FIG. 2*b*), 32 of the pipetting process, this feature comes in contact with the working fluid. The diaphragm 18, the three dimensional feature 34 and the interior cavity of the tip 12 are configured to be wetting such that retraction of the diaphragm to a controlled position allows fluid to fill the cavity defined by the deflection of the diaphragm 18 and the retraction of the piston mechanism 16. This is the motivation behind the design of the piston mechanism 16. The diaphragm 18 must be deflected to its maximum position 32 first in order to come in contact with the fluid. Then in step 3, FIG. 2*c*, 38, the piston 16 is retracted to the position shown in order to aspirate fluid volume, $V_d$. In Step 4, FIG. 2*d*, 40, the diaphragm 18 is once again deflected to its maximum position to dispense all the fluid.

The working fluid 20 may be a compressible fluid such as air or some other gas. The compressible working fluid 22 compresses when the piston 16 moves against the working fluid 22 to displace it, resulting in an increased fluid chamber pressure. Here, the working fluid acts to temporarily store a portion of the work energy transferred thereto by the piston. In one embodiment, the diaphragm 18 undergoes elastic deformation and the working fluid is compressed when the piston 16 moves against the working fluid 22 to displace it. Thus, diaphragm elasticity and working fluid compressibility may be used in various combinations to arrive at the desired deamplification ratio.

Figure 3:
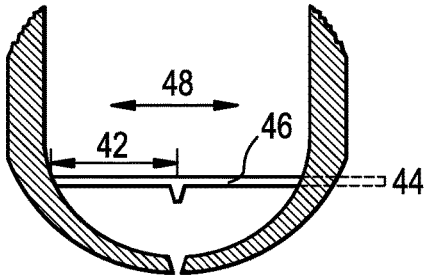
FIG. 3 is a cross-sectional view of a tip portion and diaphragm according to an embodiment of the invention.

A set of three nanoliter pipette tips 12 has been designed to exhibit the configuration stated above. Each tip 12 possesses different dimensions and initial conditions. FIG. 3 illustrates which dimensions can be varied. The diaphragm radius, 42, the diaphragm thickness, 44, the diaphragm shear modulus. 46, the diaphragm pre-stretch, 48, and the size of the fluid chamber 20. Changing the dimensions allows the pipette assembly 10 to behave differently based on which tip 12 is selected by the operator. Different tips can cause the pipette 10 to have different volume ranges and resolutions.

Figure 4:
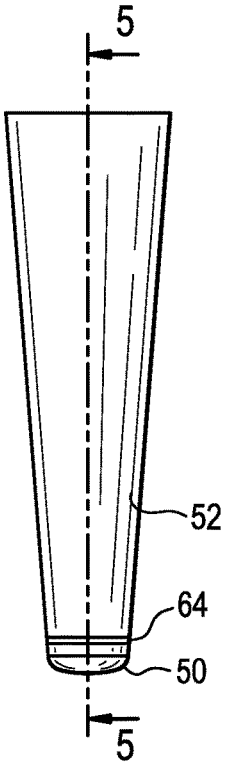
FIG. 4 is an exterior, schematic view of a nanoliter pipette tip according to an embodiment of the invention.
Figure 5:
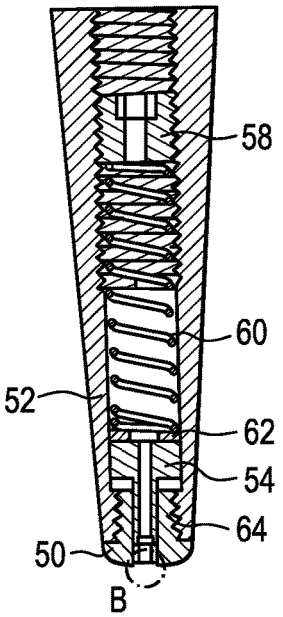
FIG. 5 is a cross-sectional view of another nanoliter pipette tip suitable for practice of the invention.
Figure 6:
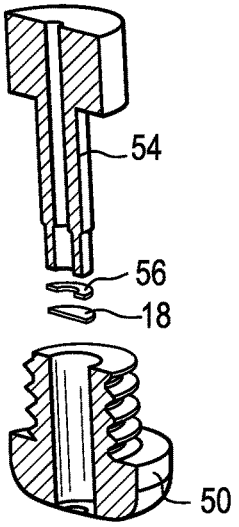
FIG. 6 is a cutaway, exploded, view of the device showing details of a tip suitable for use in the invention.
Figure 7:
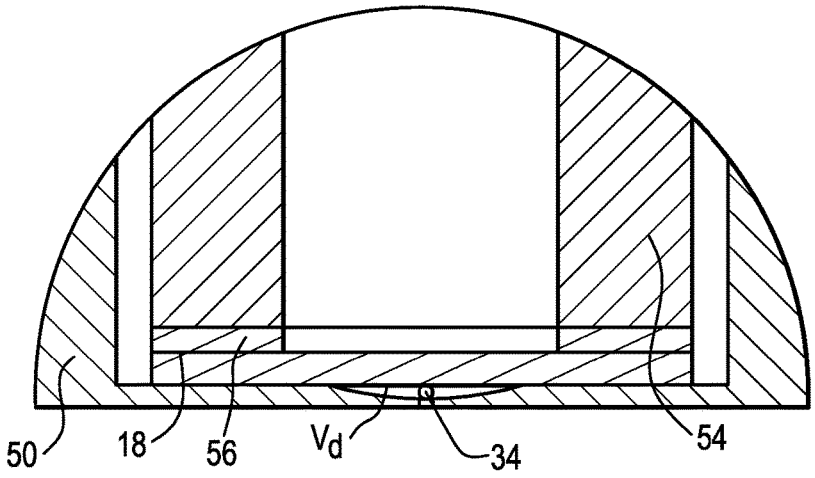
FIG. 7 is a cross-sectional view of the tip portion of another embodiment of the invention.

FIGS. 4-7 illustrate our initial embodiment of the nanoliter pipette tip 12. This tip can dispense volumes ranging from 1-10 nl. FIG. 4 is a front view of the tip 12. The tip 12 will screw onto the housing 14 and form a fluid tight seal. FIG. 5 is a cross section of the 10 nl tip 12. The tip 12 is composed of several key components, all critical to the assembly and functionality of the tip. The tip 12 is composed of two main pieces, tip bottom 50 and tip top 52. An exploded view of tip bottom 50 and its mating components can be seen in FIG. 6. The diaphragm 18 is secured to the membrane clamp 54 via adhesive 56. The adhesive makes assembly easier and holds the diaphragm pre-stretch 48. A detailed view of tip bottom 50, membrane clamp 54, the diaphragm 18, the adhesive 56, and the three dimensional diaphragm feature 34 can be seen in FIG. 7. In one embodiment, the raised feature 34 on the diaphragm is a glass microsphere that will be secured to the diaphragm via an adhesive, or can be formed as a monolithic feature of the diaphragm such as by a molding technique. FIG. 5 also features many other components in an example embodiment. A machined nut 58 secures the assembly and provides pre-load by compressing a spring 60. The preload allows for fine tuning of the compressive forces on the membrane 18. A PET washer 62 acts as a thrust bearing to prevent any torsional stress from getting to the membrane 18 via the nut 58. A gasket 64 acts to seal tip top 52 and tip bottom 50.

Figure 12:
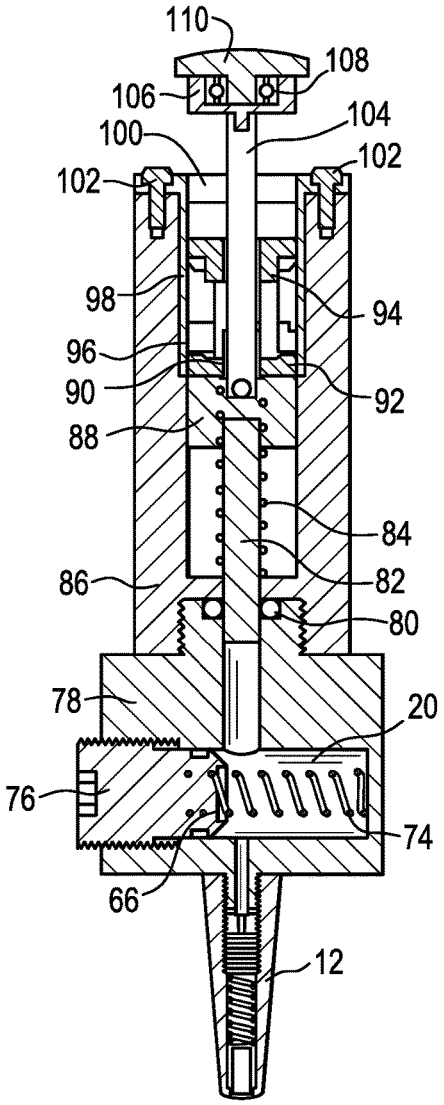
FIG. 12 is a cross-sectional view showing the specifics of a piston cam mechanism according to a preferred embodiment of the invention.

FIG. 12 delineates the specifics of the piston cam mechanism 92-98 and the chamber 78, which corresponds with the housing 14 in FIG. 1. The chamber 78 holds a sealed working volume, $V_o$, that comes in direct contact with the diaphragm 18 in the tip 12. $V_o$ can be adjusted to the correct volume via a side screw 76. The side screw 76 is preloaded via the side spring 74 to ensure that the screw does not move during operation. Additionally, a side o-ring 66 provides a fluid seal to ensure that there is no leakage in the system. The chamber 78 is connected to the tip 12 and the exterior body 86 via threads, M6 and ⅞"-14 respectively. Similarly to the side screw 76, the tip 12 is sealed via a gasket 64 and the exterior body is sealed via the top o-ring 80. Above the chamber is the dynamic portion of the mechanism as parts 82, 84, 88, 90, 92, 94 and 104 are all in motion, both vertical and rotational. The piston 82 fits into the chamber 78 and when its motion is directly coupled to that of $V_p$. It is also press fit into the interior cap 88.

Around the piston 82, is the piston spring 84. The piston spring 84, compresses during operation and provides an upward bias to the cams, 92 & 94, via the interior cap 88 and lead screw 104. The lead screw 104 is fitted into the top of interior cap 88 and is mated with the threaded bushing 90. The threaded bushing 90 is press fit into the variable cam 92. The motion and dynamics of four cams mechanisms, 92-98 are described below. The exterior cams 96 & 98 are held in place via a shoulder in the exterior body 86 and a top spacer 100. The top spacer is bolted into the exterior body 86 via four 4-40 screws of length 0.3125" 102. The thumb push 110 is coupled to the thumb connector 106 via a bearing 108 that is press fit onto both pieces.

In the exterior body 86 rests the cam mechanisms 92-98, which along with the actual piston 82 correspond to 16 in FIG. 1. These series of cams provide the repeatability and adjustability required to handle the small volumes of fluid. The cam mechanisms are made up of the exterior cam top 98, exterior cam bottom 96, interior cam 94 and the variable cam 92. The exterior cams 96, 98 fit together with mirrored offsets and rest on a shoulder in the exterior body 86. These two cams do not move during the pipetting process. During operation the interior cam 94 and variable cam 92 move up and down and rotate about the vertical axis. Before operation, the two cams can move independent of each other through the use of the lead screw 104 and the threaded bushing 90. Rotation of the lead screw, which is done manually by turning the thumb connector 106, moves the variable cam 92 up and down relative to the interior cam 94.

Figure 13A:
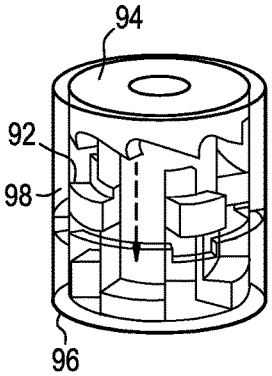
FIGS. 13*a*-13*h* are perspective views illustrating an eight-step breakdown of the cam mechanism disclosed herein.
Figure 13B:
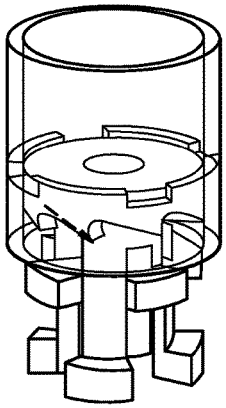
Figure 13C:
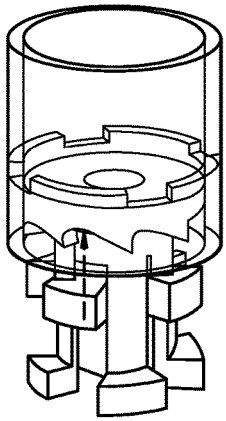
Figure 13D:
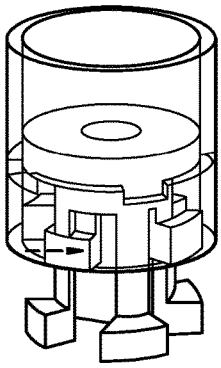
Figure 13E:
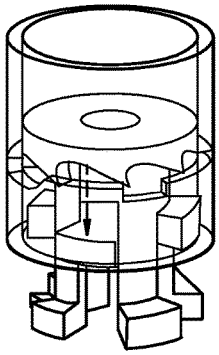
Figure 13F:
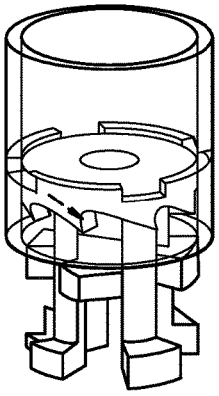
Figure 13G:
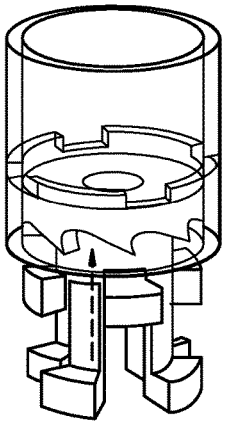
Figure 13H:
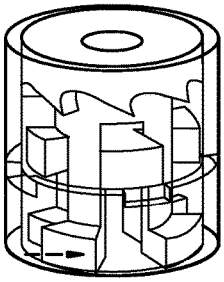

FIGS. 13*a*-13-*h* show an 8-step breakdown of the cam mechanism in operation. The interior and variable cams 92, 94 start in position 1) continue as follows: 1) the thumb push 110 is depressed causing the interior and variable cams 92, 94 to move down until the top face of the exterior cam 96 comes in to contact with the face of the interior cam 94 2) the interior and variable cams 92, 94 continue to move down and rotate 22.5 degrees due to the angular face mate to arrive at position C, 3) the thumb push 110 is released and the bottom face of the exterior cam 96 comes in to contact with the face of the variable cam 92, 4) the interior and variable cams 92, 94 continue to move up and rotate another 22.5 degrees to arrive at position E, 5) the thumb push 110 is again depressed and the interior and variable cams 92, 94 move down until the top face of the exterior cam 96 comes in to contact with the face of the interior cam 94, 6) the interior and variable cams 92, 94 continue to move down and rotate 22.5 degrees due to the angular face mate to arrive at position G, 7) the thumb push 110 is released and the bottom face of the exterior cam 96 comes in to contact with the face of the interior cam 92, 8) the interior and variable cams 92, 94 continue to move up and rotate another 22.5 degrees to arrive back at position 1). Note: all rotation is counterclockwise.

Figure 11:
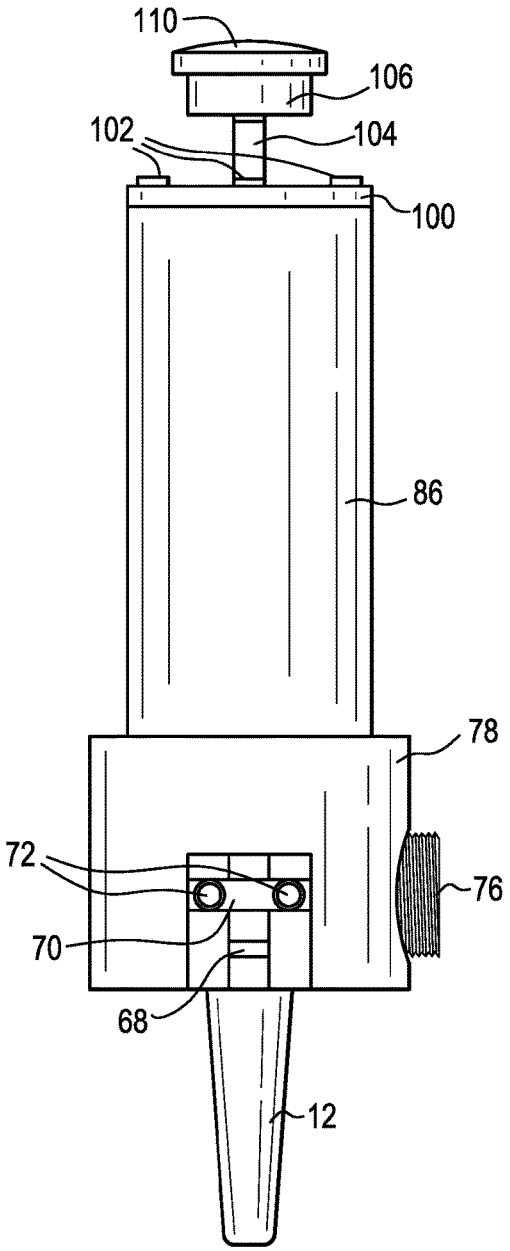
FIG. 11 illustrates a pressure relief system used to calibrate the pipette of the invention before use or adjustment.

FIG. 11 shows the pressure relief system that is used to calibrate the pipette before every use or adjustment. It is necessary for the pipette to have this capability so that the desired deamplification ratio can be achieved. The relief slider 68 can be easily pulled down to expose a relief cavity that connects directly to the inside of the sealed working fluid 20 in the chamber 78. This relief cavity is sealed by an o-ring that is not pictured in the figures. The relief slider 68 is held in place by a thin shim 70 that is mounted to the chamber 78 via two 4-40 screws with a length of 0.25" 72.

The volume deamplification principles described above and the design of a pipette tip 12 and piston mechanism 16 in accordance with the present teachings is guided by a mathematical model detailed in our earlier patent application US20130283884 A1. Using this model, pipette tip values can be selected to achieve desired pipetting performance.

EXAMPLE

Figure 8:
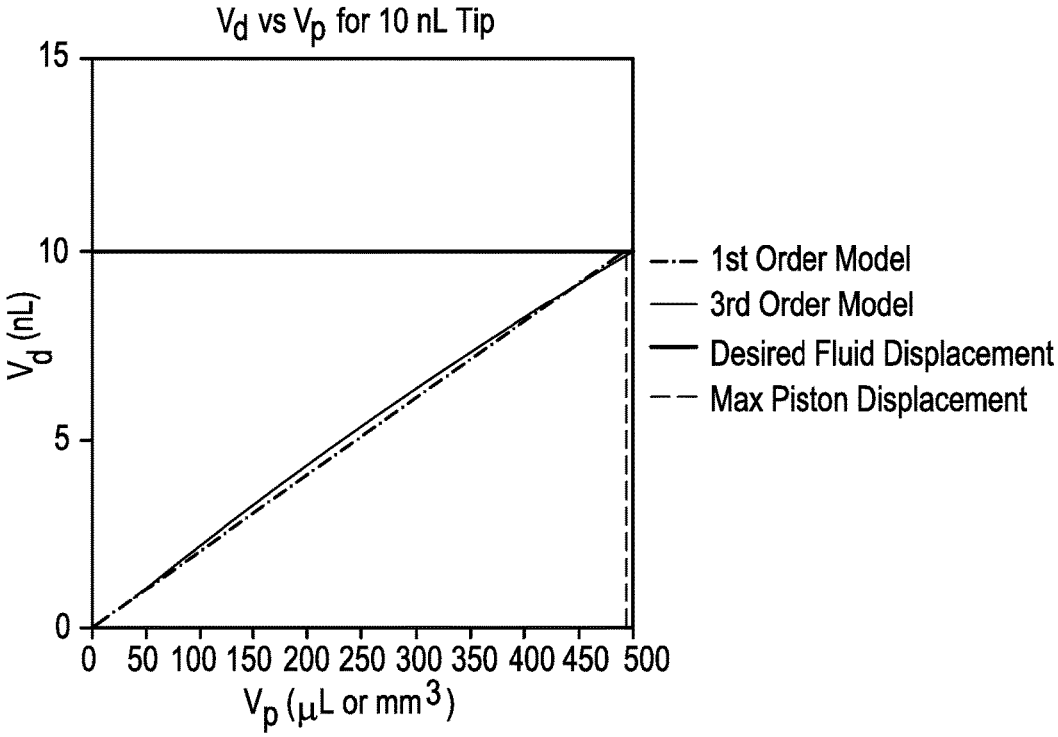
FIGS. 8, 9 and 10 are graphs of a calculated relationship of relevant volumes in embodiments of the invention.
Figure 9:
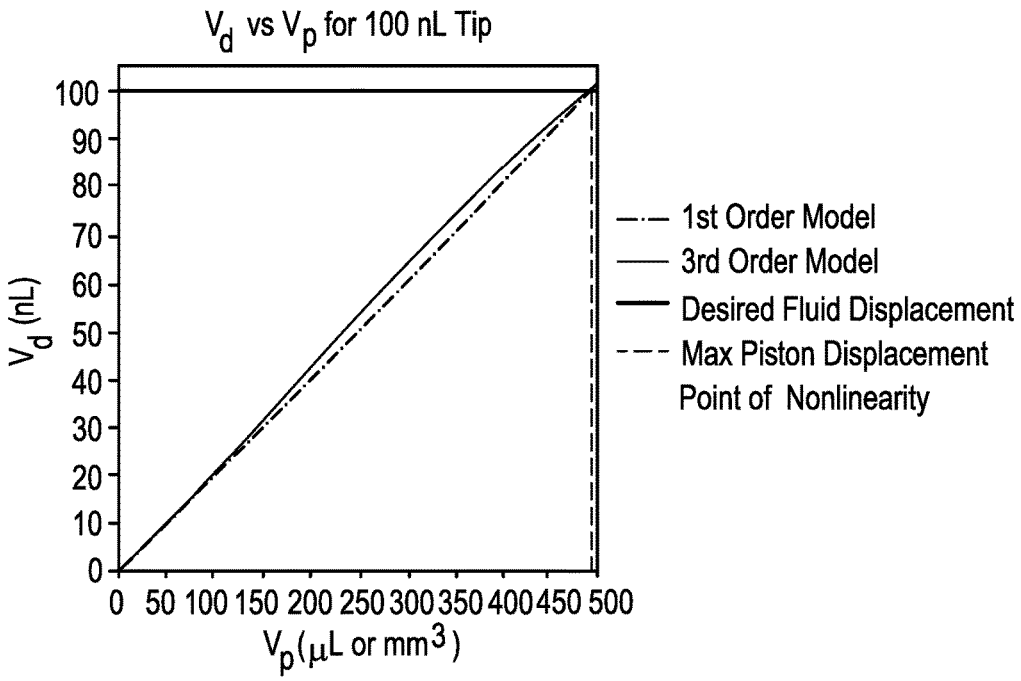
Figure 10:
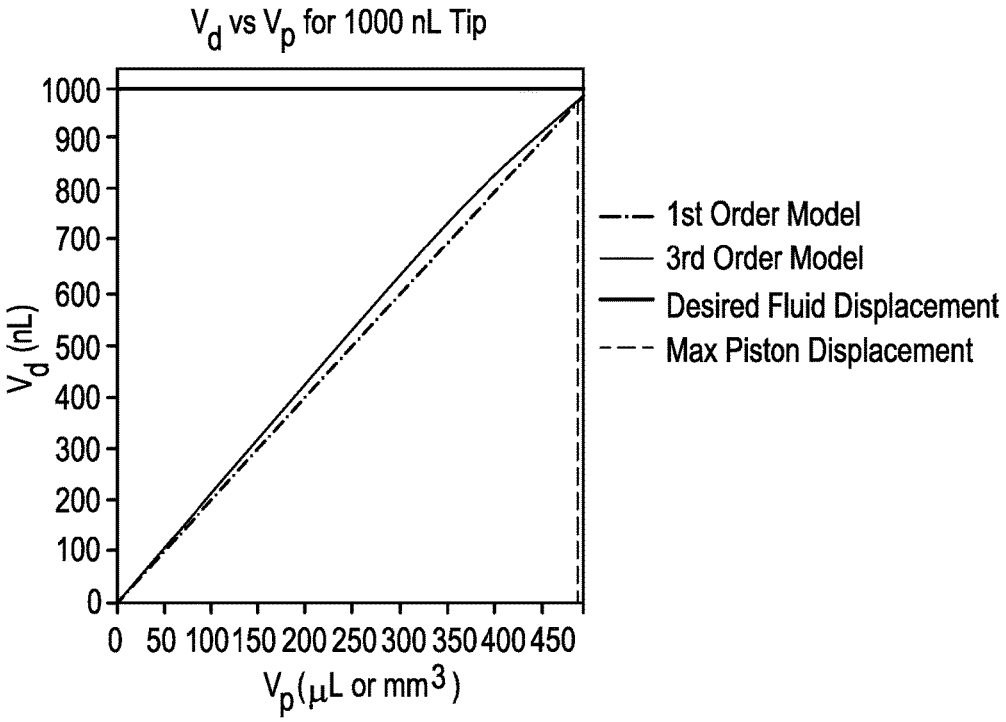

Three different pipette tips have been designed and manufactured. All three tips are compatible with the same chamber 78 and piston/cam mechanism 82, 92-98. The first tip has the ability to dispense fluids in the range of 1-10 nl. A graph of the calculated relationship $V_d$ vs $V_p$ can be seen in FIG. 8. It has a volume deamplification ratio $V_d/V_p$=49600. The second tip was designed to dispense volumes within the range of 10-100 nl. Its graph can be seen in FIG. 9. It has a volume deamplification ratio $V_d/V_p$=4960. Finally. FIG. 10 presents the final pipette tip which can dispense volumes of 100-1000 nl. It possesses a volume deamplification ratio of $V_d/V_p$=496. As can be seen in the FIGS. 8-10, the function $V_d(V_p)$ is most accurately modeled as a third order polynomial, but with careful selection of pipette tip parameters, the diaphragm radius 42, the diaphragm thickness 44, the diaphragm shear modulus 46, the diaphragm pre-stretch 48, and the initial volume of the fluid chamber 20, $V_d(V_p)$ acts approximately linear over the entire stroke of the pipette. Linearity of this function is crucial to making the pipette intuitive to use, simplifying mechanical design, and thus lower costs.

It can be appreciated that, based on the principles above and using suitable fabrication methods known to those skilled in the art, the design may be scaled to manipulate volumes smaller or larger than ~1-1000 nl. The pipette device could also be used to manipulate materials other than liquids, or liquids containing soft solids, for example biological cells. Other considerations may include electrical contact to the diaphragm and/or tip, such that electrical signals can be applied when the tip is in contact with solids and/or liquids. The design may also be employed in other configurations, such that multiple tips are arrayed in close proximity, driven by one or more piston mechanisms, which may be manual or motorized. In one example, an array of diaphragms, each within its own tip, is in contact with a single piston via a common volume of working fluid. The characteristics of the diaphragms within the array may be chosen to be the same, or to vary in a prescribed manner.

Additional information about the present invention may be found in "Universal Handheld Micropipette" Review of Scientific Instruments 87, 115112(2016) and in United States published patent application US2013/0283884. The contents of both of these references are incorporated herein by reference in their entirety.

It is recognized that modifications and variations of the present invention will be apparent to those of ordinary skill in the art and it is intended that all such modifications and variations be included within the scope of the appended claims.

What is claimed is:

1. A nanoliter pipette assembly, comprising:

a housing having a working fluid chamber, the working fluid chamber being configured to contain a working fluid therein;

a tip portion having a diaphragm disposed therein, an adjustable interior cavity defined by a volume disposed between the diaphragm and a distal interior wall of the tip portion, and an orifice for aspirating and dispensing fluid, the orifice being located at and distal of the distal interior wall; and a piston moveable within the housing to apply a force to a working fluid contained in the working fluid chamber to selectively move the diaphragm towards and away from the distal interior wall of the tip portion, wherein the assembly is configured to operate to cause the diaphragm to contact fluid disposed at a location outside of the tip portion and subsequently draw the diaphragm away from the distal interior wall of the tip portion to draw at least a portion of the contacted fluid through the orifice and into the adjustable interior cavity, and wherein the assembly is further configured to operate to advance the diaphragm towards the distal interior wall of the tip portion to displace at least a portion of the fluid previously passed into the adjustable interior cavity to a dispensing location outside of the tip portion, the at least a portion of the fluid previously passed into the adjustable interior cavity that is advanced to the dispensing location being as small as one nanoliter.

2. The nanoliter pipette assembly of claim 1, wherein the diaphragm further comprises a projection configured to pass through the orifice to contact fluid disposed at a location outside of the tip portion to draw at least a portion of the contacted fluid through the orifice and into the adjustable interior cavity.

3. The nanoliter pipette assembly of claim 2, wherein the diaphragm, the projection, and the distal interior wall of the tip portion are configured to be wetted by the fluid drawn through the orifice and into the adjustable interior cavity.

4. The nanoliter pipette assembly of claim 1, wherein prior to drawing the diaphragm away from the distal interior wall of the tip portion to draw fluid disposed at a location outside of the tip portion through the orifice and into the adjustable interior cavity, the assembly is configured to operate to advance the diaphragm towards the distal interior wall of the tip portion to displace an initial volume of fluid disposed in the adjustable interior cavity through the orifice and to a location outside of the tip portion, the location to which the initial volume of fluid is displaced being the location from which fluid is subsequently drawn into the orifice by drawing the diaphragm away from the distal interior wall of the tip portion.

5. The nanoliter pipette assembly of claim 1, wherein the linear actuation mechanism includes a series of cams configured to provide repeatability and adjustability of the amount of fluid drawn through the orifice and into the adjustable interior cavity.

6. The nanoliter pipette assembly of claim 1, further comprising a linear actuation mechanism configured to move the piston within the housing, the linear actuation mechanism further comprising a stop to set the amount of fluid drawn through the orifice and into the adjustable interior cavity, and the linear actuation mechanism being further configured to:

depress the piston to a bottom of its stroke to bringing a projection on the diaphragm into contact with the fluid disposed at a location outside of the tip portion;

retract the piston to aspirate the fluid through the orifice and into the adjustable interior cavity; and deflect the diaphragm towards a maximum position thereof to displace at least a portion of the fluid previously passed into the adjustable interior cavity to the dispensing location.

7. The nanoliter pipette assembly of claim 5, further including a thumb push button coupled to the series of cams providing an eight step operation of the pipette assembly to aspirate and then dispense the fluid, the thumb push button having an adjustable-range click-pen-type mechanism.

8. A nanoliter pipette assembly, comprising:

a housing having a working fluid chamber, the working fluid chamber being configured to contain a working fluid therein;

a tip portion having a diaphragm disposed therein, an adjustable interior cavity defined by a volume disposed between the diaphragm and a distal interior wall of the tip portion, and an orifice located at and distal of the distal interior wall; and a piston moveable within the housing to apply a force to a working fluid contained in the working fluid chamber to selectively move the diaphragm towards and away from the distal interior wall of the tip portion, wherein the diaphragm is configured to move from a first rest position to a second displacement position as the piston is advanced towards the tip portion such that fluid disposed in the adjustable interior cavity is displaced out of the adjustable interior cavity to a location outside of the tip portion via the orifice, wherein the diaphragm is further configured to move from the second displacement position to a third position as the piston is retracted away from the tip portion to draw fluid disposed at a location outside of the tip portion through the orifice and into the adjustable interior cavity, the third position being disposed between the first rest position and the second displacement position and being a designated position such that the diaphragm is configured to stop and rest at the third position without any external forces being supplied by a user of the nanoliter pipette assembly, and wherein the diaphragm is further configured to move from the third position towards the second displacement position as the piston is advanced towards the tip portion to displace at least a portion of the fluid previously passed into the adjustable interior cavity to a dispensing location outside of the tip portion, the at least a portion of the fluid previously passed into the adjustable interior cavity that is advanced to the dispensing location being as small as one nanoliter.

9. The nanoliter pipette assembly of claim 8, wherein the diaphragm further comprises a projection configured to pass through the orifice to contact fluid disposed at a location outside of the tip portion to draw the fluid through the orifice and into the adjustable interior cavity.

10. The nanoliter pipette assembly of claim 9, wherein the diaphragm, the projection, and the distal interior wall of the tip portion are configured to be wetted by the fluid drawn through the orifice and into the adjustable interior cavity.

11. The nanoliter pipette assembly of claim 8, wherein the third position is a metered position.

12. The nanoliter pipette assembly of claim 11, wherein the metered position is adjustable such that the amount of fluid drawn through the orifice and into the adjustable interior cavity when the diaphragm moves from the second displacement position to the third position can be adjusted by changing a location of the metered position.

13. The nanoliter pipette assembly of claim 12, further comprising a linear actuation mechanism configured to move the piston, the linear actuation mechanism including a series of cams configured to adjust the metered position of the diaphragm.

14. The nanoliter pipette assembly of claim 13, further comprising a thumb push button coupled to the series of cams to provide for movement of the diaphragm between the second displacement position and the metered position to draw the second volume amount into the adjustable interior cavity, and to provide for movement of the diaphragm from the metered position and towards the second displacement position to displace at least a portion of the second volume amount of the working fluid out of the orifice, the thumb push button having an adjustable-range click-pen-type mechanism.

15. The nanoliter pipette assembly of claim 8, further comprising a linear actuation mechanism having a stop configured to set the amount of fluid drawn through the orifice and into the adjustable interior cavity when the diaphragm moves from the second displacement position to the third position by setting a location of the third position of the diaphragm, and the linear actuation mechanism is configured to:

depress the piston to a bottom of its stroke to bring a projection on the diaphragm into contact with the fluid disposed at a location outside of the tip portion, prior to drawing the fluid into the adjustable interior cavity;

retract the piston to draw the fluid disposed at a location outside of the tip portion into the adjustable interior cavity; and deflect the diaphragm towards the second displacement position to displace at least a portion of the fluid previously passed into the adjustable interior cavity, out of the orifice, and to the dispensing location.

16. A pipette assembly, comprising:

a housing having a working fluid chamber, the working fluid chamber being configured to contain a working fluid therein;

a tip portion having a diaphragm disposed therein, an adjustable interior cavity defined by a volume disposed between the diaphragm and a distal interior wall of the tip portion, and an orifice located at and distal of the distal interior wall; and a piston moveable within the housing to apply a force to a working fluid contained in the working fluid chamber to selectively move the diaphragm towards and away from the distal interior wall of the tip portion, wherein the diaphragm is configured to move from a first rest position to a second displacement position as the piston is advanced towards the tip portion such that fluid disposed in the adjustable interior cavity is displaced out of the adjustable interior cavity to a location outside of the tip portion via the orifice, and wherein the second displacement position is such that the diaphragm conforms to the distal interior wall of the tip portion, resulting in a volume of the adjustable interior cavity being zero.

17. The pipette assembly of claim 16, wherein the diaphragm is further configured to move from the second displacement position to a third position as the piston is retracted away from the tip portion to draw fluid disposed at a location outside of the tip portion through the orifice and into the adjustable interior cavity, the portion of the volume of the fluid being defined as a displacement volume of the fluid, and the third position being disposed between the first rest position and the second displacement position, and wherein the diaphragm is further configured to move from the third position towards the second displacement position as the piston is advanced towards the tip portion to displace at least a portion of the displacement volume out of the orifice.

18. The pipette assembly of claim 17, wherein the diaphragm moves to the second placement position to displace the at least a portion of the displacement volume out of the orifice, thus displacing the displacement volume.

19. The pipette assembly of claim 17, wherein the diaphragm further comprises a projection configured to pass through the orifice to contact fluid disposed at a location outside of the tip portion to draw the fluid through the orifice and into the adjustable interior cavity.

20. The pipette assembly of claim 19, wherein the diaphragm, the projection, and the distal interior wall of the tip portion are configured to be wetted by the displacement volume of the fluid.

21. The pipette assembly of claim 17, comprising a linear actuation mechanism configured to move the piston, the linear actuation mechanism including a series of cams configured to adjust the third position of the diaphragm.

* * * * *